United States Patent [19]

Frawley

[11] Patent Number: 4,827,687

[45] Date of Patent: May 9, 1989

[54] CEILING MOUNTING SYSTEM

[76] Inventor: Michael Frawley, 211 Highfield Road, Camberwell, Victoria 3124, Australia

[21] Appl. No.: 64,589

[22] Filed: Jun. 22, 1987

[30] Foreign Application Priority Data

Jun. 20, 1986 [AU] Australia ..... PH6490
Dec. 10, 1986 [AU] Australia ..... PH9438

[51] Int. Cl.[4] ..... E04B 5/52

[52] U.S. Cl. ..... 52/484; 52/473; 52/726

[58] Field of Search ..... 52/473, 484, 726, 39

[56] References Cited

U.S. PATENT DOCUMENTS

| | | | |
|---|---|---|---|
| 2,920,357 | 1/1960 | Ericson | 52/484 |
| 2,924,856 | 2/1960 | Price | 52/484 |
| 2,971,617 | 2/1961 | Smith | 52/484 |
| 4,004,390 | 1/1977 | Merkwitz | 52/484 |
| 4,614,072 | 9/1986 | Price | 52/484 |

FOREIGN PATENT DOCUMENTS

| | | | |
|---|---|---|---|
| 666936 | 11/1965 | Belgium | 52/484 |
| 3125614 | 1/1983 | Fed. Rep. of Germany | 52/484 |
| 2426781 | 1/1980 | France | 52/473 |
| 2458640 | 2/1981 | France | 52/484 |

*Primary Examiner*—Henry E. Raduazo
*Attorney, Agent, or Firm*—Cushman, Darby & Cushman

[57] ABSTRACT

A ceiling mounting system for assembly with a building structure is described, the system including a mounting channel having a web for mounting of a ceiling panel, the channel also having two opposed generally upright legs having top edge portions. The legs extend upwardly from the web to the top edge portions. An elongated support member in the shape of an inverted channel is supported by the building structure and extends transverse to the mounting channel, the elongated support member including two lower edge portions and two support means integral with the lower edge portions, the support means being located at the lower edge portions and being spaced apart in the longitudinal direction of the mounting channel to resist twisting of the mounting channel relative to the support member when the mounting channel is engaged with and supported by the two spaced support means. The support means comprise support tabs arranged to co-operate with and to directly support the top edge portions of the upright legs of the mounting channel so that the mounting channel is directly supported by the elongated support member.

7 Claims, 4 Drawing Sheets

CEILING MOUNTING SYSTEM

This invention relates to the mounting of ceilings in buildings.

In one known ceiling mounting system there is provided a series of generally 'C' shaped metal channel sections which are mounted parallel to each other and mounted to or suspended from the building structure. A series of generally parallel 'U' shaped ceiling mounting channels are then arranged to extend transverse to and to be suspended from the 'C' shaped channels. Ceiling panels can then be mounted to the 'U' shaped mounting channels e.g. by means of screws passing through the panels into the lower connecting web of the mounting channel 'U' shaped. The mounting channels are suspended from the 'C' shaped channel by means of clips. The clips have flanges at the top which overlie the 'C' shaped channels and which are bent downwardly and inwardly to hook into the 'C' shaped channels.

There are several disadvantages of this ceiling mounting system. For example the suspension clips can be readily exewed so that they do not properly support the ceiling mounting channels. The clips also are slidable along the 'C' shaped channels and, particularly when erecting a sloping ceiling this slipping can be difficult to control. Also the 'C' shaped channel can readily be knocked out of position so text it collapses onto its side to adopt a 'U' shape.

It is an object of the present invention to provide an improved ceiling mounting system which can be simple to erect and effective in operation.

It is a preferred object of the present invention to provide improvements in component joining and suspension arrangements for use in ceiling mounting systems and particularly to provide joining and suspension arrangements which are simple to use and effective in operation.

According to the present invention there is provided a ceiling mounting system for assembly with a building structure, the system including ceiling mounting means for mounting a ceiling in position, the ceiling mounting means including: a mounting channel having a web for mounting of a ceiling panel, the channel also having two opposed generally upright legs having top edge portions, the legs extending upwardly from the web to the top edge portions, and an elongated support member arranged to be supported by the building structure and for extending transverse to the mounting channel, the elongated support member including a lower edge portion and support means integral with the lower edge portion. The support means comprising support tabs arranged to co operate with and to directly support the top edge portions of the upright legs of the mounting channel so that the mounting channel is directly supported by the elongated support member.

The present invention also provides a ceiling mounting system for assembly with a building structure, the system including ceiling mounting means for mounting a ceiling in position. The ceiling mounting means including: a mounting channel having a web for mounting of a ceiling panel. The channel also having two opposed generally upright legs having top edge portions. The legs extending upwardly from the web to the top edge portions, and an elongated support member arranged to be supported by the building structure and for extending transverse to the mounting channel, the elongated support member including a lower edge portion and two support means arranged to be operatively associated with the mounting channel, the support means being located at the lower edge portion and being spaced apart in the general longitudinal direction of the mounting channel so as to thereby resist twisting of the mounting channel relative to the support member when the mounting channel is engaged with and supported by the two spaced support means.

The present invention further provides a system for assembly with a building structure, the system including ceiling mounting means for mounting a ceiling in position, the ceiling mounting means including: a ceiling mounting channel having a web for mounting of a ceiling panel, the channel also having two opposed generally upright legs extending upwardly from the web, and an elongated support member arranged to be supported by the building structure and for extending transverse to the mounting channel, the mounting channel in use being directly supported by the elongated support member.

Possible and preferred features of the present invention will now be described with particular reference to the accompanying drawings. However it is to be understood that the features illustrated in and described with reference to the drawings are not to be construed as limiting on the scope of the invention in the drawings.

Figures 11A, 11B:
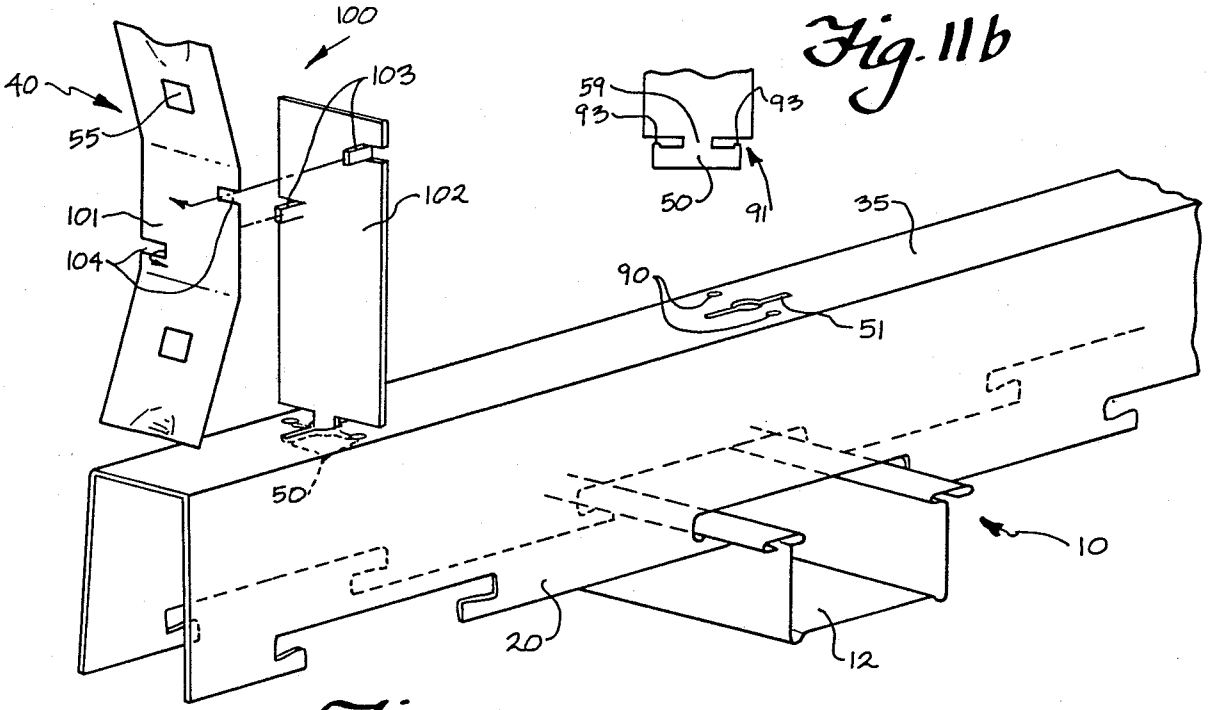

FIGS. 11*a* and 11*b* show features of the suspension arrangement including further aspects of the invention.

Figure 6:
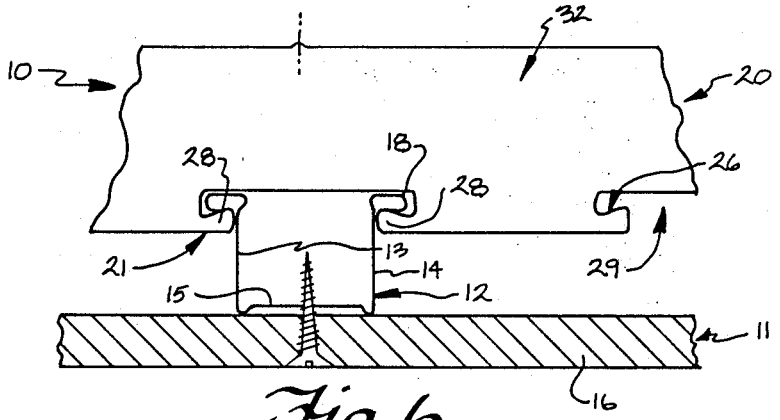
FIG. 6 is a side elevation of a second ceiling mounting system in use.
Figure 8:
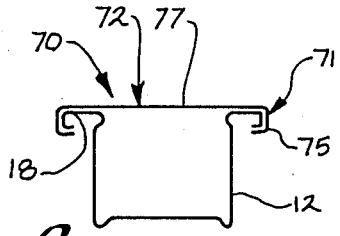
FIG. 8 is a sectional view of the joining piece of FIG. 7 in use.

The drawings illustrate a ceiling mounting system for a building structure although the invention is equally applicable to other building panel mounting systems. The system includes ceiling mounting means 10 for mounting the ceiling 11 in position. The ceiling mounting means 10 includes a ceiling mounting channel 12 having two opposed generally upright legs 13. 14 and a connecting web 15 between the legs at the bottom for mounting of ceiling panel(s) 16 or other components of the ceiling system. The channel 12 has the same shape throughout its entire length. The channel 12 may be made of galvanised steel or other suitable material and is resilient so that the opposed legs 13, 14 can be squeezed together to a degree or pulled apart but will spring back to original shape. The channel 12 may be one of the kinds which are presently commercially available. For example, the channel 12 in FIGS. 1 and 9 has the top edges 17 of the legs 13, 14 turned inwardly and downwardly. In FIGS. 6 and 8, the channel 12 has the top edges 18 of the legs 13, 14 turned outwardly then downwardly and back towards the channel again.

The ceiling mounting means 10 also includes an elongated support member 20 to be supported from the building structure and for extending generally transverse to the ceiling mounting channel 12 and being designed to support the channel 12. The elongated support member 20 includes a plurality of support means 21 integral with the support member 20 and arranged to co-operate with the ceiling mounting channel 12 to support it in use.

Figure 1:
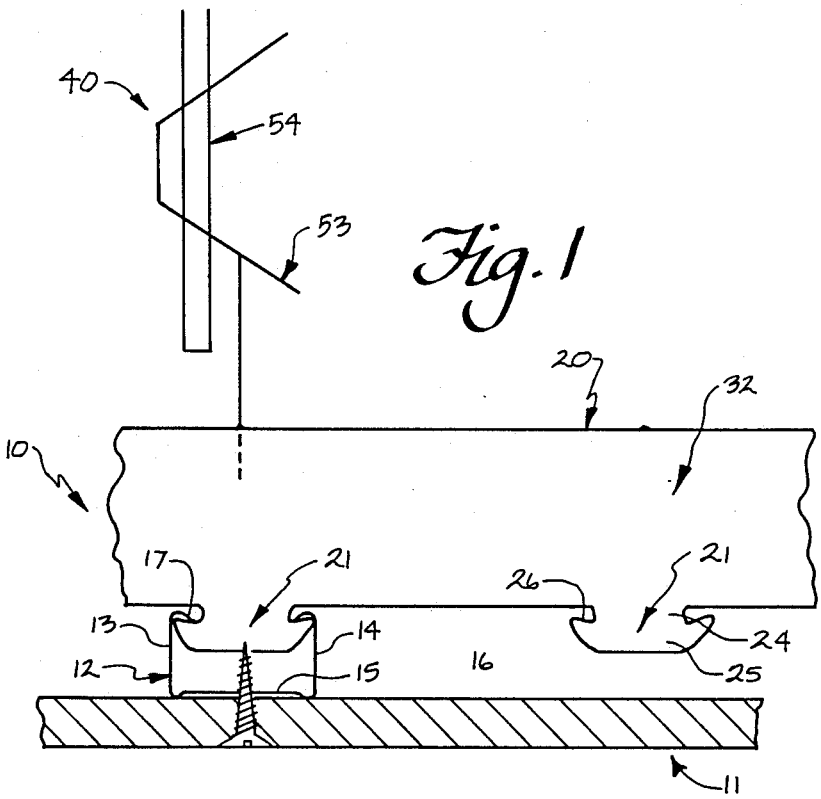
FIG. 1 is a side elevation of one ceiling mounting system in accordance with the invention.
Figure 2:
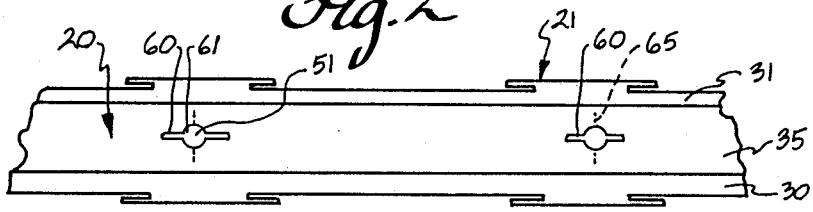
FIG. 2 is a top plan of the elongated support member being used in the FIG. 1 system.
Figure 3:
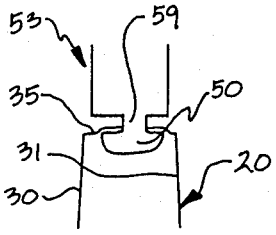
FIG. 3 is a section through the support member of FIG. 2 showing a suspension clip.

In the FIG. 1 case where the channel 12 is generally 'U' shaped and has the top edges 17 of the opposed legs 13, 14 turned inwardly, each support means 21 includes a neck section 24 projecting downwardly from the support member 20, the neck section 24 having at the lower end an enlarged head 25 arranged to fit within the ceiling mounting channel 12. The ledges 26 formed where the head section 25 joins the neck section 24 are arranged to fit under and support the inwardly turned upper edges 17 of the channel legs 13, 14. To assemble this channel 12 with the support means 21 the legs 13. 14 may be separated to a degree until the head 25 is received within the channel 12' after which release of the separating force allows the opposed upright legs 13, 14 to spring back towards each other.

In the FIG. 6 case where the ceiling mounting channel 12 is of the kind having outwardly turned upper edges of the channel legs 13, 14, the support means 21 comprises two facing hook sections 28. These hook sections 28 are provided at the bottom edge of the elongated support member 20. With this arrangement the opposed legs 13, 14 of the channel 12 can be squeezed towards each other enabling the outwardly turned edges 18 to pass through the space between the facing hook sections 28, after which the compressive force can be released and the legs 13, 14 spring apart so that the hook sections 28 are arranged beneath and support the outwardly turned edges 18 of the channel legs 13, 14.

The elongated support member 20 may be made of a sheet material such as galvanised steel. The support means 21 are provided at the spaced locations along the bottom edge of the sheet material elongated member 20. In FIG. 6, the hook sections 28 are defined by generally tab shaped sections which face each other across a narrowed passage 29 opening into an enlarged cut out. The corners of the tabs 28 are rounded, particularly where the tabs 28 join the main body of the support member 20 in order to prolong the working life of the die used to punch out the desired bottom edge shape of the support member 20. Also rounding of the corners of the tabs 28 where they join the main body of the support member avoids an unnecessarily weak point in the metal. The upper edges 26 of the tabs 28 are inclined slightly so that the depth of the tabs increases slightly in the direction facing towards the outer free ends. These inclined surfaces 26 being arranged to be engaged by the downwardly and inwardly turned edges 17 of the channel legs 13, 14. In this way the edges 17 will tend to bite into the tab upper edges 26 to resist inadvertent separation of the ceiling mounting channel.

Two support means 21 (although in other embodiments there may be more that two) extend from the elongated support member 20, each of the two support means 21 being arranged to co-operate with a single ceiling mounting channel 12 at positions spaced along the channel 12. This will result in the two support means 21 resisting twisting of the ceiling mounting channel 12 and also in a stronger support.

The elongated support member 29 is in the form of an inverted channel 32 and a plurality of support means 21 are arranged along the lower edges of the opposed channel legs 30, 31 so that pairs of support means 21 are located opposite each other across the width of the mouth of the inverted channel 32. The two support means 21 of each such pair are both arranged to co-operate with the same ceiling mounting channel 12 as it extends transverse to the inverted channel 32.

The inverted channel 32 forming the elongated support member 20 may be made of sheet metal such as galvanised steel and may be stamped to form the support means 21 at the edges thereof, after which the sheet is roll formed to form the inverted channel 32 with the support means 21 thus being arranged along the lower edges of the opposed legs 30, 31 of the inverted channel 32. The channel shape 32 may flare slightly in the downwards direction so that the channels 32 can be nested together for storage and transport. With channels 32 nested together there is great resistance to sliding of the channels 32 against each other which can otherwise tend to happen particularly in transport. Of course nested channels 32 also require less storage or packing volume.

Figure 4:
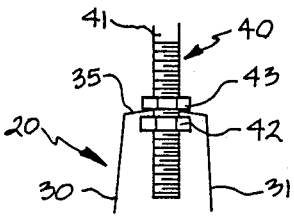
FIG. 4 is a section through the support member of FIG. 2 showing a suspension rod.

The ceiling mounting system may be used such that the elongated support members 20 are secured directly to the building structure e.g. to ceiling joists or the like. Alternatively the elongated support members can be used with suspension means 40 forming part of the ceiling mounting system. In FIG. 4 the suspension means 40 comprises threaded rods 4 which are arranged to be supported so as to extend downwardly from the building structure, the threaded rods 41 passing through respective holes provided in the web 35 of the inverted channel 32. The nut 42 can then be threaded onto the lower end of the rod 41 and tightened to adjust the height of the support channel 32. A lock nut 43 can be provided on the threaded rod 41 to be tightened down against the top of the support member 32.

In FIGS. 1 to 3 and 5 the suspension means 40 for suspending the ceiling mounting means 10 from the building structure includes a plurality of suspension heads 50. The suspension heads 50 are arranged to co-operate with suspension apertures 51 in the elongated support member 20 (or the suspension apertures may be associated with the suspension means and the heads with the elongated support member). The heads 50 are arranged to pass through the apertures 51 and, upon relative turning, to resist disengagement so as to thereby suspend the elongated support member 20.

The suspension means 40 comprises of plurality of suspension clips 53 for mounting to the building structure e.g. to ceiling joists, purlins, rafters, or other structural components. The suspension clips 53 as illustrated are mounted to the building structure via generally vertical suspension rods 54. The suspension clips 53 may be made from metal plate and are generally 'C' shaped. Holes 55 are provided through the top and bottom arms 57 of the 'C' shape so that a suspension rod 54 can pass through the holes 55 upon pressing of the arms 57 of the 'C', shape together, after which the arms 57 of the 'C' shape can be released to spring back and the edges of the holes 55 in the arms 57 engage with the rod 54 to resist sliding of the clip 53 down the rod.

The suspension head 50 is provided at the bottom of a downwardly extending leg 58. The leg 58 is integral with and extends downwardly from the 'C' shaped clip 53. The suspension head 50 is defined by a neck section 59 of the metal plate spaced slightly above the bottom end. The co-operating suspension apertures 51 each comprises an elongated slot 60 through which the suspension head 50 can e passed. To enable relative turning of the suspension head 50 after passing through the elongated slot 60, there is provided an enlarged hole 61 in the general centre of the slot 60 so that the head 50 can be passed through the slot and then clip 53 can be turned through 90 degrees with the neck section 59 being in the enlarged hole 61. The head 50 then prevents vertical withdrawal of the clip 53. The suspension apertures 51 are provided in the connecting web 35 of the inverted channel 32.

A furrow 65 is provided in the web 35 of the inverted channel 32, the furrow 65 extending transverse to the slot 60 forming the suspension aperture 51. The furrow 65 is formed in the underside of the web 35 so that the suspension head 50 engages in the furrow 65 to resist turning of the head 50 back to the position where withdrawal of the head 50 through the suspension aperture 51 would be possible. The furrow 65 is in the form of a crease in the metal plate extending transverse to the general line of the slot 60 cut through the web 35. The crease can be formed at the time that the suspension aperture 51 is punched. For example the crease can be formed by a part of the suspension aperture punching die which is arranged to engage with and deform the metal to form the crease.

The ceiling mounting system as illustrated in FIGS. 1 to 8 is used in a way which is analogous in many respects to the present system. The suspension rods 54 are mounted to the building structure. After this the elongated support channel 32 is moved into its approximate position and the 'C' shaped suspension clips 53 have their suspension heads 50 passed through the slots 60 in the support channel 32. The clips 53 are then turned through 90 degrees and fed onto the suspension rods 40. Alternatively the suspension clips 53 can be moved into position, the clips 53 moved downwardly so that the heads 50 pass through the slots 60 in the inverted channels 32 after which the clips 53 can be turned 90 degrees and adjusted in height along the rods.

Figure 7:
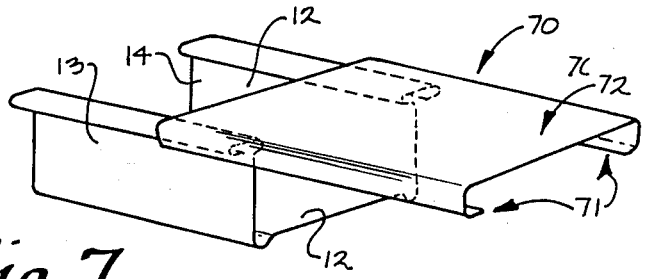
FIG. 7 is a perspective view of a joining piece usable with the resent invention.

In the case where the ceiling mounting channel 12 has outwardly turned upper edges 18 (FIG. 6), the legs 13, 14 of the mounting channel 12 can be squeezed together and the channel 12 lifted into the support means 21 on the bottom edges of the elongated support channel 32. The squeezing pressure is released and the legs 13, 14 of the mounting channel 12 spring out to engage with and be supported by the support means 21. In the other possibility where the ceiling mounting channel 12 has inwardly turned upper edges 17 (FIG. 1), the upright legs 13, 14 of the mounting channel 12 can be pulled apart (or forced apart by ramped edges of the heads 25) and lifted into engagement with the support means 21 on the bottom edges of the elongated support channel 32. This pressure is then released and the legs 13. 14 of the mounting channel 12 spring back towards each other to engage with and be supported beneath the elongated support channel 32. In FIG. 7 there is shown a joining member 70 for joining two ceiling mounting channels 12 together in end to end relationship, the ceiling mounting channels 12 having opposed legs 13, 14. The joining member 70 comprises two opposite attaching means 71 for engaging with respective legs 13, 14 of the ceilingmounting channels 12 and spacing means 72 holding the opposite attaching means 71 in spaced relationship. In use the attaching means 71 are arranged to co-operate with the legs 13, 14 of the ceiling mounting channels 12 in a way to allow sliding movement of the joining member 70 along the mounting channels 12 so that the joining member 70 can be engaged with one length of mounting channel 12 in the vicinity of an end thereof, another length of mounting channel abutted against the end of the first mounting channel 12 and the joining member 70 then slid along to engage with the second length and retain the two mounting channels against relative movement in a direction other than the general longitudinal direction of the mounting channels.

The two opposite attaching means 71 are comprised by attaching hook formations 75 for co-operating with projecting portions of the ceiling mounting channels. For example in FIG. 8 where each ceiling mounting channel 12 has legs 13, 14 which have their top edges 18 turned outwardly, the hook formations 75 turn inwardly to engage with and slide along the outwardly turned edges 18 of the legs 13, 14. In the particular preferred arrangements, the formations 75 define channels for receiving therein the turned out edges 18 of the channel legs 13, 14.

Figure 9:
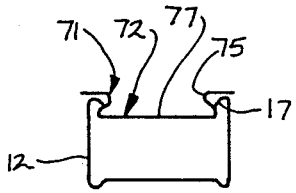
FIG. 9 is a cross sectional view of an alternative joining piece used with a channel with inwardly turned edges.

In FIG. 9 each mounting channel 12 has inwardly turned leg edges 17, the hook formations 75 turn outwardly to define channels receiving in use the turned in leg edges 17.

The spacing means 72 holding the opposite attaching means 71 in spaced relationship comprises a spacing web 77. In the FIG. 7 embodiment the joining member 70 comprises a length of sheet material such as galvanised steel sheet, the opposite edges of the sheet being turned downwardly and inwardly to define opposite facing channels. This configuration of joining member 70 allows the member to be slid onto one end of a ceiling mounting channel 12 having edges 18 turned outwardly. The joining member 70 still allows the channel legs 13, 14 to be squeezed towards each other for mounting to the support means 21. This arrangement of joining member 70 also allows two abutting ceiling mounting channels 12 to be joined together at or in close proximity to the support channel 32 since the joining member 70 itself can be dimensioned to fit between the support means 21 in the form of tabs 28.

It will be seen that the joining member 70 can be readily made for example from galvanised steel strip which can be roll formed and cut to suitable lengths. The joining member 70 is simple and effective in use and can be installed more readily than the currently used generally 'U' shaped clips which presently are crimped to each of the legs 13, 14 of two abutting channels 12.

Figure 10:
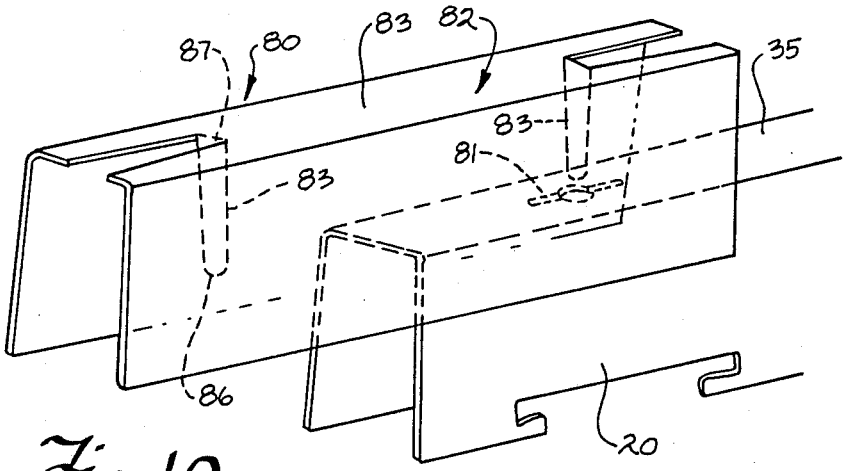
FIG. 10 is a perspective view of a support joining member.

In FIG. 10 there is shown a support joining member 80 for joining two elongated support members 20 together in end to end and preferably abutting relationship, each elongated support member 20 having an aperture 81 therein near the end abutting the other support member. The support joining member 80 includes an overlap piece 82 for overlapping both the adjacent ends of the two elongated support members 20, the support joining member 80 further including two prongs 83 projecting from the overlap piece 82 and arranged to pass through respective ones of the apertures 81 in the support members 20, the prongs 83 being deformable after passing through the apertures 81 so as to resist withdrawal of the prongs 83 from out of the apertures 81 and thus resist separation of the elongated support members 20.

The apertures 81 in the elongated support members 20 are constituted by the suspension apertures provided in the support members 20 for the purpose of suspending the support members 20 from the building structure.

The overlap piece 82 of the support joining member 80 includes a generally planar piece 83 arranged to lie flat against the elongated support members 20, the prongs 83 projecting out of the general plane of the planar piece 83. The planar piece 83 comprises a generally rectangular plate has the width of the web 35 of the inverted support channel 32. In this way the planar piece 83 can lie against the webs 35 of the abutting support members 20. The overlap piece 82 overall may be in the form of an inverted channel of complementary shape to the channel shape of the support members 20 so that the channelshaped overlap piece 82 can closely nest with the abutting ends of the support members 20. The planar piece 83 in this arrangement comprises a connecting web of the inverted channel shaped overlap piece 82.

The prongs 83 of the elongated support member are deformable after passing through the apertures 81, such deformation comprising bending of the prongs 83 to lie flat against the respective elongated support members 20. The prongs 83 are formed integral with the overlap piece 82 and extend at right angles to the general plane of the overlap piece. For example the prongs 83 may be formed by bending upwardly out of the plane of the overlap piece 82 fingers or narrow strips defined by spaced cuts formed in the end edges of the overlap piece 82. Each prong 83 may taper slightly from a rounded outer tip 86 to the fold line 87 where the prong 83 joins with the overlap piece, the width of the tapering prong 83 at the tip 86 being less than the diameter of the apertures 81 but increasing to be equal to or fractionally wider than the diameter of the apertures 81 to thereby achieve a tight fit when the support Joining member 80 is engaged with the abutting support members 20 by insertion of the two prongs 83 through the two apertures 81.

The support joining member 80 may be made from galvanised steel sheet material by stamping and roll forming. The support joining member 80 can be easily installed by hand with the prongs 83 being bent over manually to secure the abutting support members 20 together.

In FIGS. 11*a* and 11*b* there is shown a suspension arrangement 40 which includes at least one retaining recess 90 provided adjacent each suspension aperture 51, and a co-operating projection 91 provided on each suspension head 50 for co-operating with a respective retaining recess 90 such that the head 50 can be passed through the aperture 51, rotated relative to the aperture and the projection 91 engaged in the retaining recess 90 to resist turning of the suspension head 50 back into a position enabling withdrawal through the aperture.

In the preferred arrangement there are provided two retaining recesses 90 on opposite sides of each suspension aperture 51 and two co operating projections 91 on each side of the suspension head 50. Each retaining recess 90 comprises a hole spaced laterally from the adjacent slot shaped aperture 51 and each projection 91 comprises a tab 93 projecting from the suspension head 50 adjacent the neck section 59 so that the tabs 93 enter the retaining holes 90 straddling the slot to thereby inhibit rotation of the suspension head 50 back into line with the slot 51.

Figure 5:
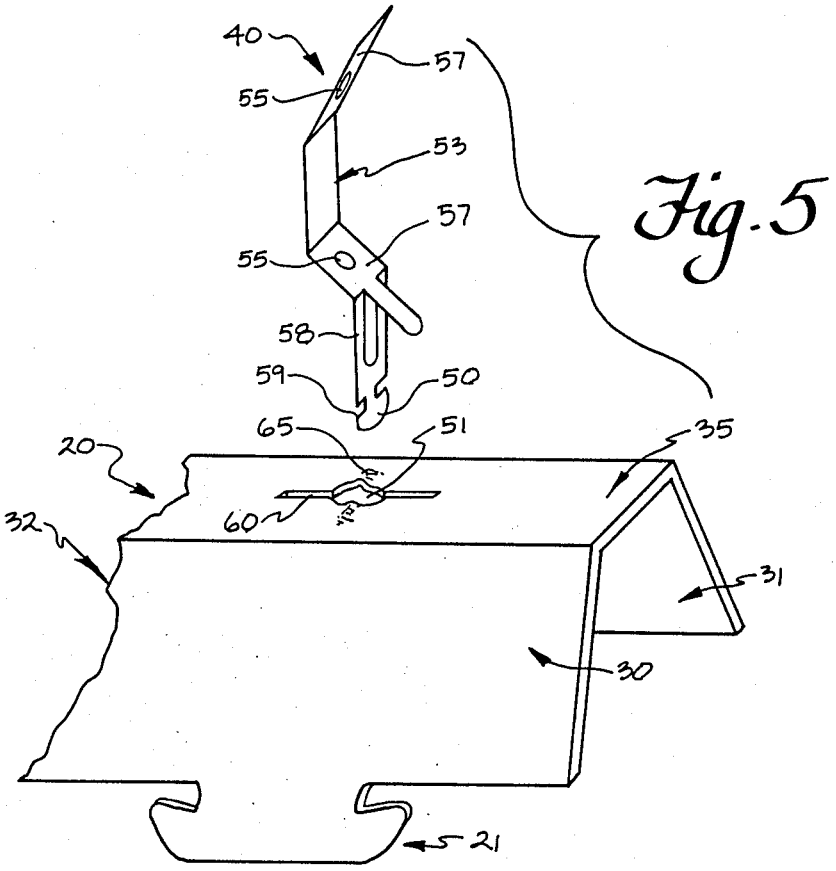
FIG. 5 is an exploded perspective view of a suspension clip and support member.

The suspension clip 53 of FIG. 5 may be difficult to manufacture or may be difficult to install if there is little room to rotate the clip 53 after the support channel 32 has been moved into its general position beneath the clip 53. In FIG. 11*a* there is shown a two piece suspension clip 100 for use in suspending ceiling mounting means 10 from a building structure, the clip including a concave spring piece 101 for engaging with a suspension rod (not shown) and a suspension piece 102 for co-operating with a support member 20 by means of a suspension head 50 co-operating with a suspension aperture 51, the spring piece 101 and suspension piece 102 being securable together.

The securing of the spring piece 101 and the suspension piece 102 may be by any convenient securing means such as by means of rivet(s) passing through the two pieces. The securing means as shown in FIG. 11*a* comprises a co-operating tab and hole arrangement, the tabs 103 being provided in one of the pieces and the co-operating holes 104 being provided in the other piece such that the tab 103 can be bent flat after passing through the holes 104 to thereby retain the two pieces 101, 102 together. The spring piece 101 as with the one piece suspension clip in FIG. 5 can be provided with two holes 55 for receiving therethrough the suspension rod.

With this two piece clip 100 the spring piece 101 can be located on the suspension rod and the suspension piece 102 can have its head 50 passed through the slot in the elongated support member web 35 after which the suspension piece 102 is turned 90 degrees so that the head 50 resists withdrawal from the slot. The support member 20 is then moved into position and the suspension piece 102 secured to the spring piece 101 by bending flat the tabs 103 after passing through the co-operating holes 104.

It can be seen that the components of the preferred illustrated ceiling mounting systems, with the exception of the suspension rods, can be made from sheet material such as metal, particularly galvanised steel. The support channel 32 can be stamped and rolled to the desired inverted channel configuration. The ceiling mounting channels 12 can be the standard presently commercially available kinds of channels. The suspension clips 53, 100 can be stamped and formed from a single strip of resilient metal.

The system described herein enables the elimination entirely of the clips presently used between the "C" shaped support channel and the "U" shaped ceiling mounting channel. The ceiling configuration and support system does not need to be re-erected or reset after being worked upon for example by electricians since the structure is rigid and substantially immovable after initially being set up. Also of course there will be no slipping of the components of the system, even when a sloped ceiling is being constructed. The installation labour required will be substantially less than with the present system.

Because the system is rigid and can be made stronger than the present by using effectively two closely spaced mounting means 21 at each suspension point, it may be possible to increase the spacing between the ceiling mounting channels 12 from the presently used 1200 mm spacing to say 1800 mm spacing without loss of overall strength.

Although systems are described for two presently commercially available ceiling mounting channels, the preferred system would use the channel 12 having outwardly turned upper edges 18 of the channel legs 13, 14 since it will be easier to squeeze the legs 13, 14 towards each other for installation than to separate the legs of the channel with the FIG. 1 and 9 arrangement.

The use of two spaced support means 21 at each suspension point for the ceiling mounting channels 12 will resist twisting of the channel 12 during the installation so that the system will not be readily disturbed or dislodged. Also the ceiling mounting channels 12 or other components can be readily removed at any time without destruction or permanent distortion of the components, as would happen in the past with the clips which would need to be bent back from their retaining configurations.

The illustrated systems provide simple and effective means for joining the ceiling mounting channels 12 and elongated support members 20. Also simple and effective features of the suspension arrangement used in a ceiling mounting system are provided.

What I claim is:

1. A ceiling mounting system for assembly with a building structure, the system including ceiling mounting means for mounting a ceiling in position, the ceiling mounting means including: a mounting channel having in cross section a web for mounting a ceiling panel, said channel also having two opposed generally upright legs with top edge portions which include outwardly turned upper edges, said legs extending upwardly from the web to the top edge portions, and an elongated support member arranged to be supported by the building structure and for extending transverse to the mounting channel, the elongated support member including a lower edge portion and support means integral with the lower edge portion, the support means comprising support tabs arranged to co-operate with and to directly support said top edge portions so that the mounting channel is directly supported by the elongated support member, the support tabs being defined by two facing hook sections provided at a lower portion of the elongated support member, and having a space between the facing hook sections, the arrangement being such that the opposed legs of the mounting channel can be moved towards each other to enable the outwardly turned upper edges to pass through the space between the facing hook sections after which said legs can be moved apart so that the hook sections are located beneath and support the outwardly turned upper edges of said legs, each of the support tabs having an upper edge which is inclined so that the depth of the tab increases in the direction towards its outer free end, the inclined upper edge of the tab being engaged by the upper edge of the associated leg thereby resisting inadvertent separation of the mounting channel.

2. A ceiling mounting system as claimed in claim 1 wherein the elongated support member includes two support means arranged to be operatively associated with the mounting channel, the two support means being located at the lower edge portion and being spaced apart in the general longitudinal direction of the mounting channel so as to thereby resist twisting of the mounting channel relative to the support member when the mounting channel is engaged with and supported by said support means.

3. A ceiling mounting system as claimed in claim 2 wherein the elongated support member is in the general form of an inverted channel having two opposed downwardly extending channel legs and an upper connecting web between the legs, the two support means being provided at the lower edges of the channel legs so that the two longitudinally spaced support means are located opposite each other across the mouth of the inverted channel,

4. A ceiling mounting system for assembly with a building structure, the system including ceiling mounting means for mounting a ceiling in position, the ceiling mounting means including: a mounting channel having in cross section a web for mounting a ceiling panel, the channel also having two opposed generally upright legs having top edge portions, the upright legs extending upwardly from the web to the top edge portions, and an elongated support member arranged to be supported by the building structure and for extending transverse to the mounting channel, the elongated support member including a lower edge portion and support means integral with the lower edge portion, the support means comprising support tabs arranged to co-operate with and to directly support the top edge portions of said upright legs so that the mounting channel is directly supported by the elongated support member, suspension means for suspending the mounting means from the building structure, the suspension means including a suspension head, the mounting means having an associated suspension aperture, the suspension head being arranged to co-operate with the suspension aperture by passing through the aperture and, after relative turning, to resist disengagement so as to thereby supportingly suspend the elongated support member, the suspension head being provided at the lower end of a downwardly suspension leg, the suspension head being defined by a neck section of the suspension leg, the co-operating suspension aperture comprising an elongated slot in the support member through which the suspension head can be passed and subsequently rotated so that the head cannot be vertically withdrawn through the slot, the suspension head being provided with an upwardly extending projection and a co-operating recess being provided adjacent the suspension slot, the arrangement being such that the suspension head can be passed through the suspension slot, relatively rotated and then lifted so that the projection engages in the recess to resist turning of the suspension head back to the position where withdrawal of the suspension head through the suspension slot is possible.

5. A ceiling mounting system as claimed in claim 4 wherein the elongated support member includes two support means arranged to be operatively associated with the mounting channel, the two support means being located at the lower edge portion and being spaced apart in the general longitudinal direction of the mounting channel so as to thereby resist twisting of the mounting channel relative to the support member when the mounting channel is engaged with and supported by the two spaced support means.

6. A ceiling mounting system as claimed in claim 5 wherein the elongated support member is in the general form of an inverted channel having two opposed downwardly extending channel legs and an upper connecting web between the legs, the two support means being provided at the lower edges of the channel legs so that the two longitudinally spaced support means are located opposite each other across the mouth of the inverted channel.

7. A ceiling mounting system as claimed in claim 4 wherein the suspension means comprises a two piece suspension clip, the clip including a concave spring piece having holes through which a suspension rod suspended from the building structure passes and a suspension piece for co-operative engagement with the support member, the suspension piece being provided with the suspension head for co-operating with the suspension aperture in the support member, the arrangement being such that the spring piece can be mounted on the suspension rod and the suspension piece can have its head operatively associated with the suspension aperture, the support member being then moved into its general desired position and the suspension piece then secured to the spring piece.

* * * * *